US005412546A

United States Patent [19]

Huang

[11] Patent Number: 5,412,546

[45] Date of Patent: May 2, 1995

[54] POWER WRENCH

[76] Inventor: Chen S. Huang, 4F, No. 5, Alley 2, Lane 105, Min-An Road, Hsin-Chuang City, Taipei Hsien, Taiwan, Prov. of China

[21] Appl. No.: 277,845

[22] Filed: Jul. 20, 1994

[51] Int. Cl.[6] ..... B25B 13/00

[52] U.S. Cl. ..... 362/119; 81/57.14; 81/63; 81/54; 173/93; 173/176

[58] Field of Search ..... 81/467, 429, 472, 473, 81/474, 476, 54, 57.14, 63, 57.33, 61, 62; 173/178, 93.5, 12, 93, 163, 104, 117; 362/119

[56] References Cited

U.S. PATENT DOCUMENTS

| | | | |
|---|---|---|---|
| 2,855,679 | 10/1951 | Gibble | 362/119 X |
| 3,734,205 | 5/1973 | Maurer | 173/93.5 |
| 4,727,780 | 3/1988 | Huang | 81/54 |
| 4,920,831 | 5/1990 | Huang | 81/54 |
| 4,947,939 | 8/1990 | Hung | 173/12 |
| 5,035,161 | 7/1991 | Huang | 81/54 |
| 5,158,354 | 10/1992 | Simmons | 362/119 |
| 5,267,129 | 11/1993 | Anderson | 362/96 |

*Primary Examiner*—Ira S. Lazarus
*Assistant Examiner*—Thomas M. Sember
*Attorney, Agent, or Firm*—Notaro & Michalos

[57] ABSTRACT

A power wrench includes a housing inside which an electric motor is mounted. A torque/rotation transmission mechanism is also disposed inside the housing to be coupled to the motor to drive a driving tip thereof extending out of a front end of the housing for engagement with a bolt/nut to be loosened or tightened. The transmission mechanism includes a cylindrical main body with a cylindrical projection concentrically integral therewith to connected to the spindle of the motor so as to transmit rotation to the main body. A coupling member is pivotally mounted on the main body and controlled by a centrifugal clutch to intermittently hit an output shaft along a circumferential direction to apply a torque impulse to the output shaft for loosening or tightening the bolt or nut. A lamp is provided on the front end of the housing to project a light beam to the bolt or nut to allow the operator to monitor the operation of the power wrench in a dark environment.

7 Claims, 6 Drawing Sheets

POWER WRENCH

FIELD OF THE INVENTION

The present invention relates generally to a power wrench for loosening/tightening bolts, especially wheel stub bolts/nuts, and in particular to a portable power wrench which is capable to apply torque impulse to the wheel stub in an intermittent fashion.

BACKGROUND OF THE INVENTION

It is well known that automobile wheels are usually fixed on the axles by stud nuts and for the sake of safety, the stud nuts are usually screwed extremely tight. This makes loosening a wheel from an axles a very tough job for drivers having no power tool at hand. Nowadays, the most powerful bolt/nut loosening device generally available in the market is the pneumatic tool which, in one hand, is bulky in size and thus heavy in weight to be carried on a car, and on the other hand, is expensive for it requires an air compressor to supply pressurized air.

To overcome such a problem, it has been developed several kinds of electrically-driven devices suitable for being carried in an automobile, especially a passenger car, for loosening/tightening wheel stud bolts/nuts. Examples are U.S. Pat. Nos. 4,727,780, 4,920,831 and 5,305,161. The device of '780 patent requires manual intervention to apply a torque impulse to a nut or bolt to be loosened/tightened. This is apparently quite inconvenient.

The devices disclosed in '831 and '161 patents use a centrifugal clutch to control the application of torque impulse to the bolt or nut. The torque impulse is transmitted through a torque source to an output shaft through a coupling member which is angular position adjustable by control elements which are separated from and controlled by the centrifugal clutch. In a first position of the centrifugal clutch, the control elements allow the coupling member to engage the output shaft and in a second position of the centrifugal clutch, the engagement is disabled.

The use of separate control elements makes the assembly and operation of the wrench of this type difficult and complicated. A similar device with two control pins integrated on the centrifugal clutch to overcome such a difficult is disclosed in U.S. Pat. No. 4,947,939, entitled "Structure of Motorized Screw Bolt Driving Tool". The tool disclosed in '939 patent is, quite obviously, an improvement over the wrenches disclosed in '831 and '161 patents. The tool of '939 patent, although effective in overcoming the problem mentioned above, has several disadvantages. For example, the '939 patent discloses a structure which has a spindle holder separated from a swivel member. The spindle holder is connected to the spindle of a motor and the swivel member is keyed to the spindle holder so that the rotation of the motor spindle is transmittable to the swivel member. Since devices of this kind are intended to loosen overtightened bolt or nut, a Great torque impulse is always transmitted through the structure thereof and under this situation, the key which is used to connect the spindle holder to the swivel member is very easy to break for such a great torque has to be solely born by the key which has only a small cross sectional area to support the great torque.

Furthermore, all the patents mentioned above has the disadvantage of unsuitability of operating in a dark environment, such as at night without lightening, so that separate lightening is required for using such devices, for example at night.

It is therefore desirable to provide an improved device for loosening/tightening bolts/nuts which overcomes the problems mentioned previously.

SUMMARY OF THE INVENTION

The principal object of the invention is to provide a power device for loosening and/or tightening bolts and nuts.

It is another object of the present invention to provide a power wrench which incorporates a light source to facilitate operation in a dark environment.

In accordance with the present invention, there is provided a power wrench comprising a housing inside which an electric motor is mounted. A torque/rotation transmission mechanism is also disposed inside the housing to be coupled to the motor to drive a driving tip thereof extending out of a front end of the housing for engagement with a bolt/nut to be loosened or tightened. The transmission mechanism comprises a cylindrical main body with a cylindrical projection concentrically integral therewith to connected to the spindle of the motor so as to transmit rotation to the main body. A coupling member is pivotally mounted on the main body and controlled by a centrifugal clutch to intermittently hit an output shaft along a circumferential direction to apply a torque impulse to the output shaft for loosening or tightening the bolt or nut. A lamp is provided on the front end of the housing to project a light beam to the bolt or nut to allow the operator to monitor the operation of the power wrench in a dark environment.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
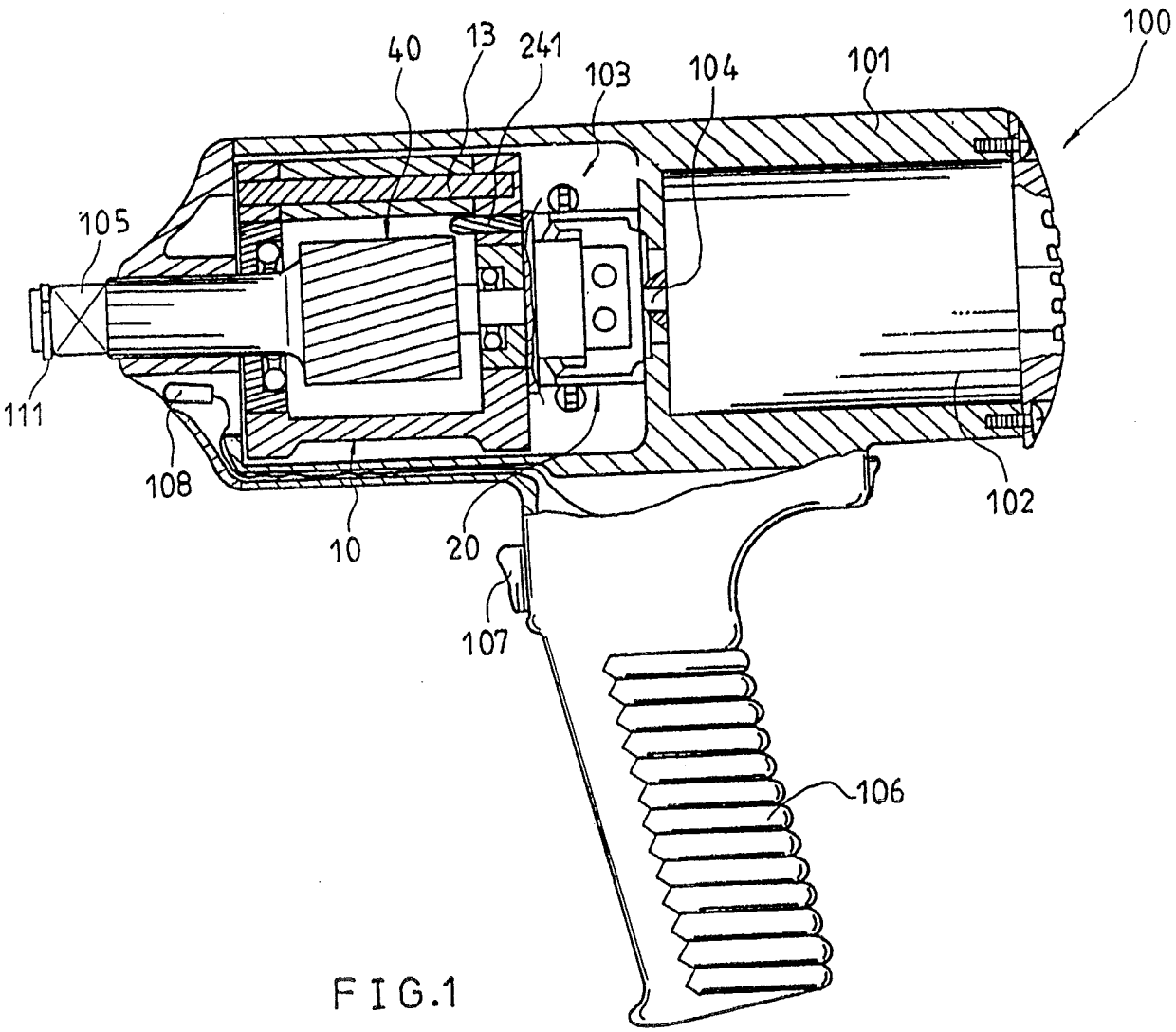
FIG. 1 is a cross-sectional view showing a power wrench constructed in accordance with a preferred embodiment of the present invention.

With reference to the drawings and in particular FIG. 1, wherein a power wrench constructed in accordance with the present invention, generally designated with the reference numeral 100, is shown, the power wrench 100 generally comprises a housing 101 inside which a torque/rotation source, preferably a reversible electrical motor 102, is secured. A torque/rotation transmission mechanism 103 which is also encased in the housing 101 is coupled to a spindle 104 of the motor 102 to be driven thereby. The torque/rotation transmission mechanism 103 comprises a driving tip 105 extending out of the housing 101 from a front end thereof and adapted to engage a nut/bolt to be loosened/tightened, preferably via a socket (not shown) for performing nut loosening/tightening operation.

A handle 106 extends from the housing 101 for hand holding the power wrench 100. An ON/OFF switch 107 is provided on the handle 106 to manually power on/off the motor 102 by supplying electricity from an external power source (not shown) to the motor 102.

Figure 2:
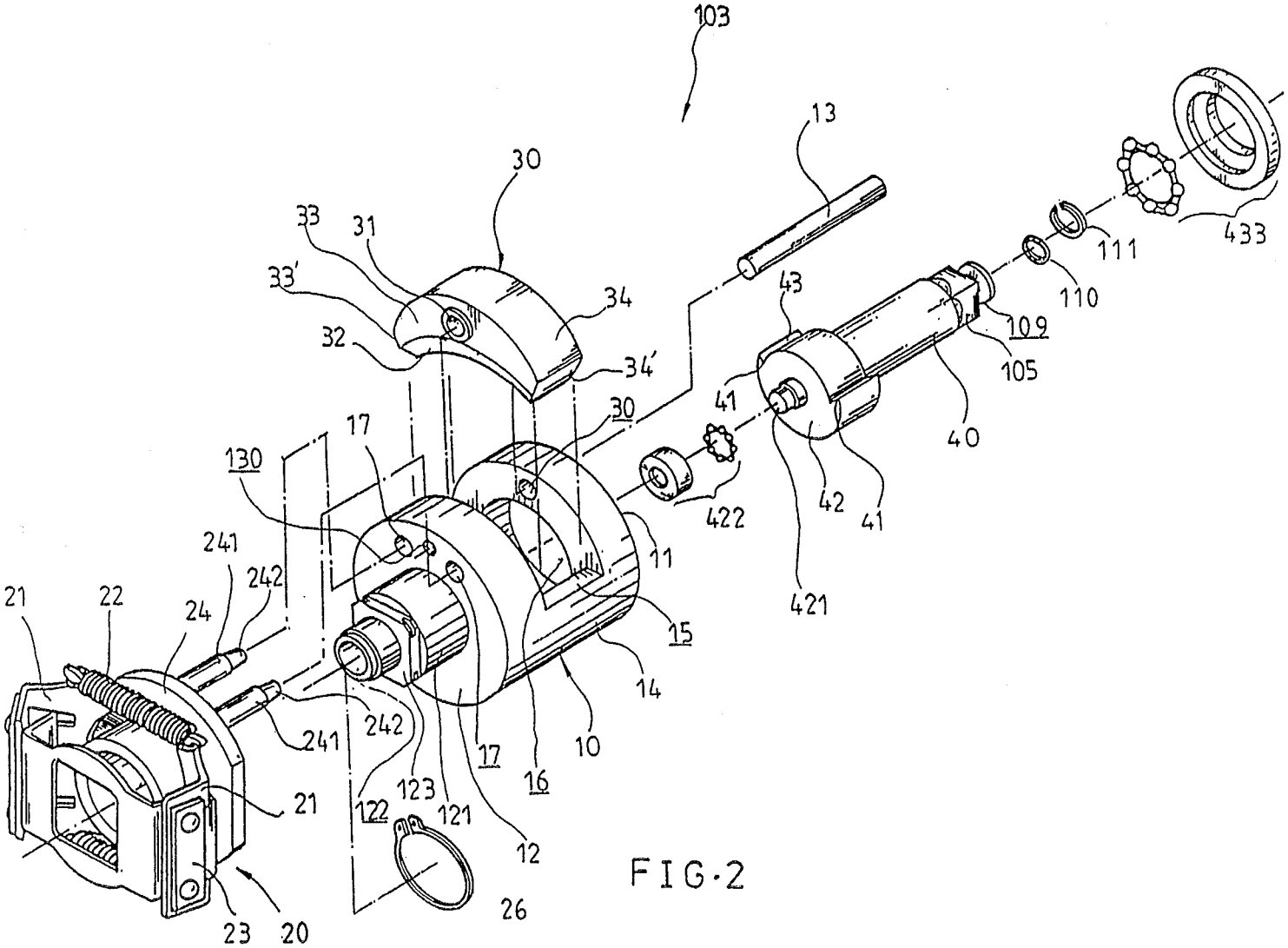
FIG. 2 is an exploded perspective view showing a torque transmission mechanism adapted in the power wrench shown in FIG. 1.

With particular reference to FIG. 2, wherein the torque/rotation transmission mechanism 103 is shown, the torque/rotation transmission mechanism 103 comprises a hollow cylindrical main body 10, having an open end 11 and a closed end 12 connected together by a cylindrical circumferential side wall 14. A projection 121, preferably cylindrical, is co-axially or concentrically mounted to the closed end 12 of the main body 10 with a central hole 122 extending therethrough to receive and engage therein the spindle 104 (FIG. 1) of the motor 102 in a co-axial fashion so as to transmit torque/-rotation from the motor 102 to the main body 10.

The main body 10 comprises a radial notch 15 formed on the side wall 14 thereof to receive therein a coupling member 20 of complemental shape and size. A pivot pin 13 extends through holes 130 formed on the main body 14, located on two sides of the notch 15, and a hole 32 formed on the coupling member 30 to allow the coupling member 30 to -be freely rotatably mounted within the notch 15. The hole 32 is formed on a central portion of the coupling member 30 with two opposite wings 33 and 34 extending laterally from the central portion where the hole 32 is formed.

Preferably, each of the wings 33 or 34 has a thickened, remote end edge 33' or 34' which points into the notch 15, and the free rotation of the coupling member 30 about the pivot pin 13 allows either one of the thickened end edges 33' and 34' to move from a neutral position where the coupling member 30 is substantially flush with the side wall 14 of the main body 10 and thus the thickened end edges 33' and 34' are located substantially symmetrical with respect to the main body 10 and not moved further into the notch 15 so as to form a continue cylindrical surface with the cylindrical side wall 14 of the main body 10 to a working position where one of the thickened end edges 33' and 34' is moved further deeply into the notch 15.

Preferably, an annular projection 31 is formed around the hole 32 on each side of the coupling member 30 that faces the sides of the notch 15. The annular projections 31 function to provide small gaps 150 (FIGS. 5 and 6) between the coupling member 30 and the notch 15 for reducing contact friction therebetween so as to facilitate the relative rotation of the coupling member 30 with respect to the main body 10.

The open end 11 of the main body 10 has a central opening 16 formed thereon through which an output shaft 40 is rotatably inserted to have an expanded end 42 thereof located within the hollow cylindrical main body 10 and substantially registered with the notch 15 or the coupling member 30, and an opposite, driving tip end 105 extending therefrom to project out of the front end of the housing 101, as shown in FIG. 1.

The expanded end 42 of the output shaft 40 comprises a pair of toothed portions 41 each comprising a flat surface 43 extending substantially along a radial direction of the expanded end 42 so as to form a pair of radial steps on the expanded end 41 that face each other. The toothed portions 41 are so shaped and sized as to be rotatable within the main body 10 when the coupling member 30 is in the neutral position, but engageable by one of the thickened end edges 33' and 34' of the wings 33 and 34 of the coupling member 30 when the coupling member 30 is rotated relative to the main body 10 to the working position where the one of the thickened end edges 33' and 34' is moved deeply into the notch 15.

The expanded end 42 of the output shaft 40 comprises an axle portion 421 axially extending therefrom to be rotatably supported within the main body 10 by means of bearing means 422. Similarly, the driving tip end 105 of the output shaft 40 also comprises bearing means 423 to rotatably support the driving tip end 105 on the housing 101, as shown in FIG. 1.

Figure 8:
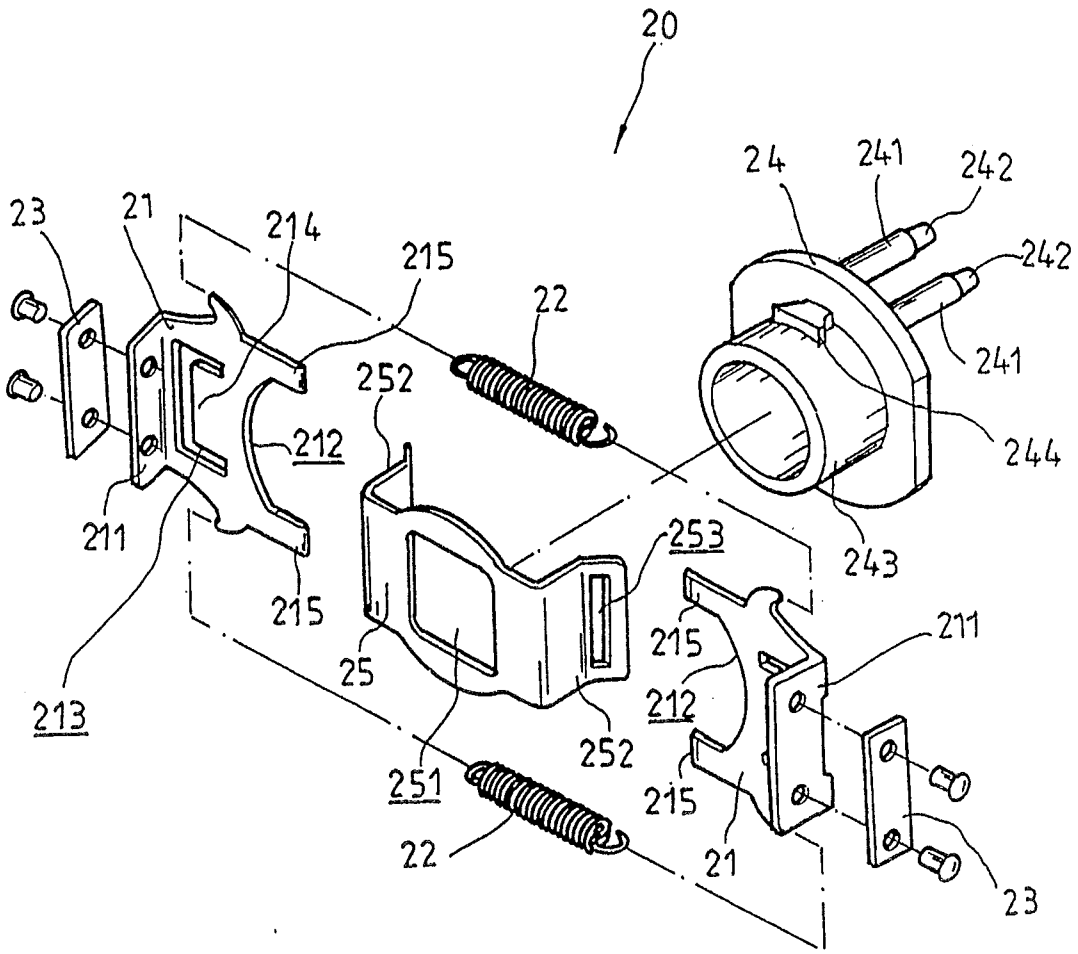
FIG. 8 is an exploded perspective view showing the centrifugal clutch of FIG. 7.
Figure 7:
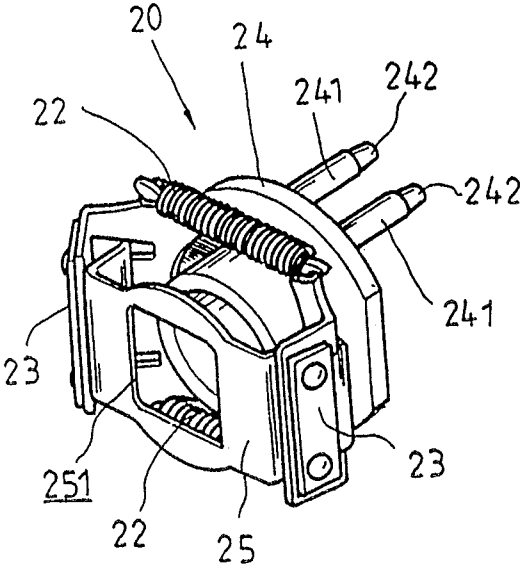
FIG. 7 is a perspective view showing the centrifugal clutch with the control pins integral therewith adapted in the power wrench shown in FIG. 2.

A centrifugal clutch 20 is fit on the projection 121 of the closed end 12 of the main body 10 and held thereon by means of C clip 26 (FIG. 2). As best seen in FIGS. 7 and 8, the centrifugal clutch 20 comprises a disk-like member 24 having a first surface facing the closed end 12 of the main body 10 on which at least a control pin 241 is formed to point toward the closed end 12 of the main body 10. It is preferable to have two such control pins 241 integrally mounted on the disk 24 as illustrated in the specific embodiment shown in the drawings.

The disk 24 also has a second surface facing away from the closed end 12 of the main body 10 on which a cylinder 243 is formed to be movably or slidably fit over the projection 121 of the main body 10.

Figure 3:
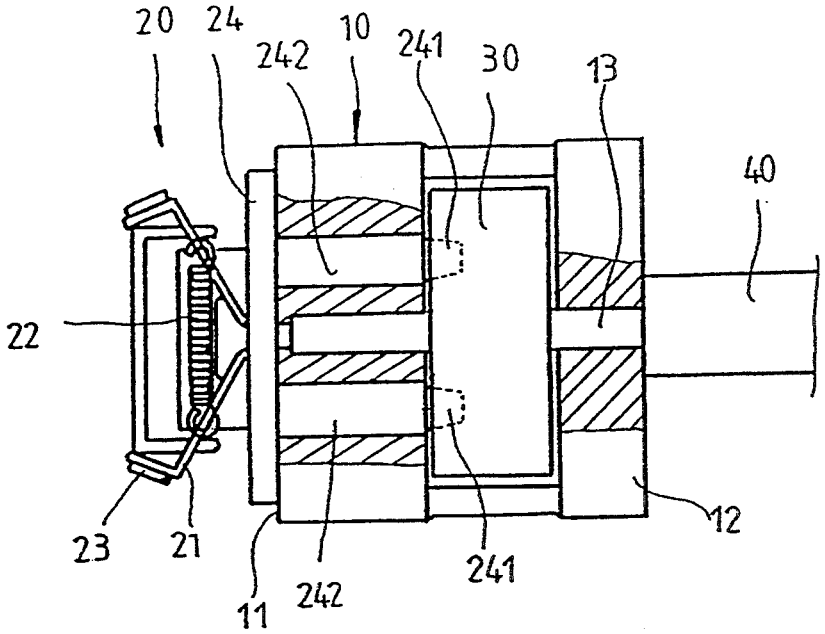
FIGS. 3 and 4 are top views, partially broken, respectively showing the engagement and disengagement of the control pins with the coupling member in the power wrench of FIG. 1.
Figure 4:
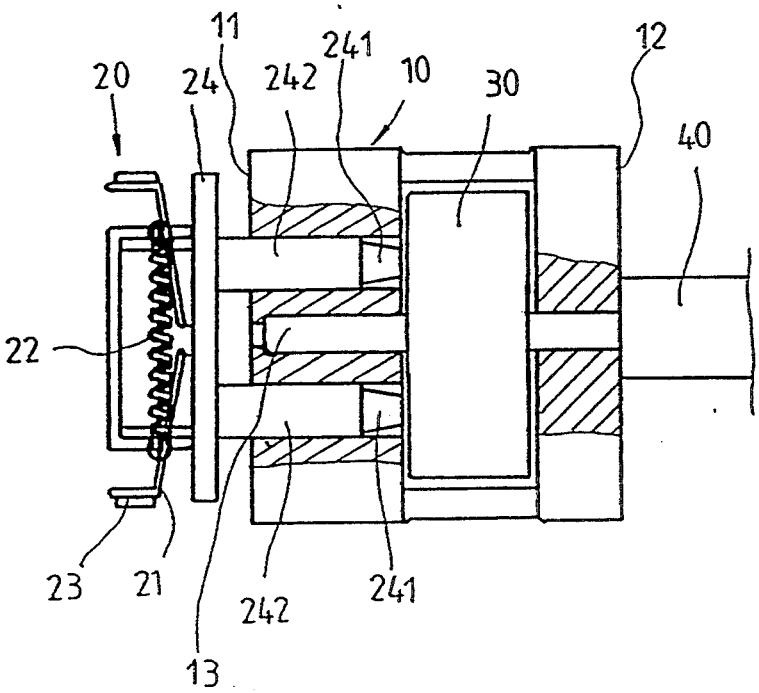
Figure 5:
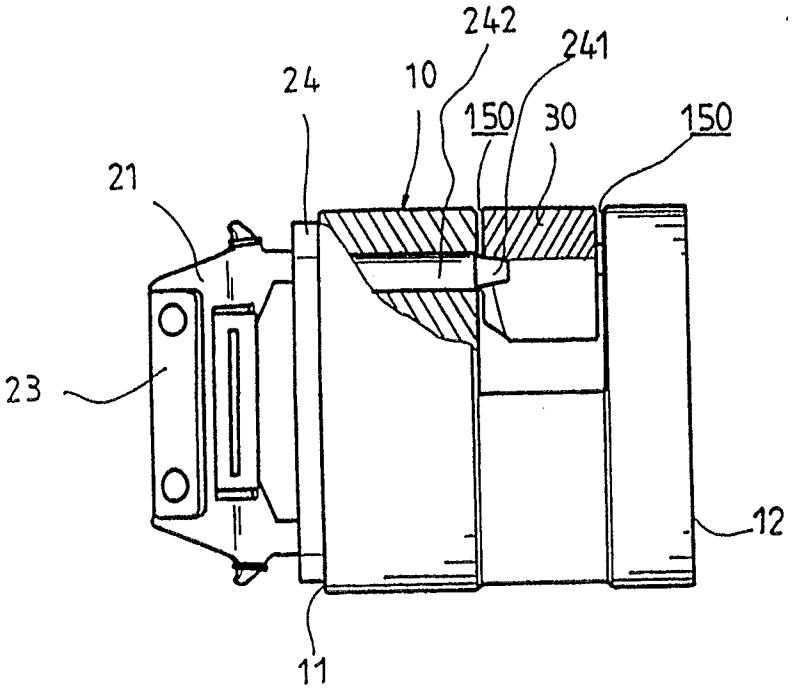
FIGS. 5 and 6 are side elevational views, partially broken, showing the engagement and disengagement of the control pins with the coupling member, respectively associated with FIGS. 3 and 4.
Figure 6:
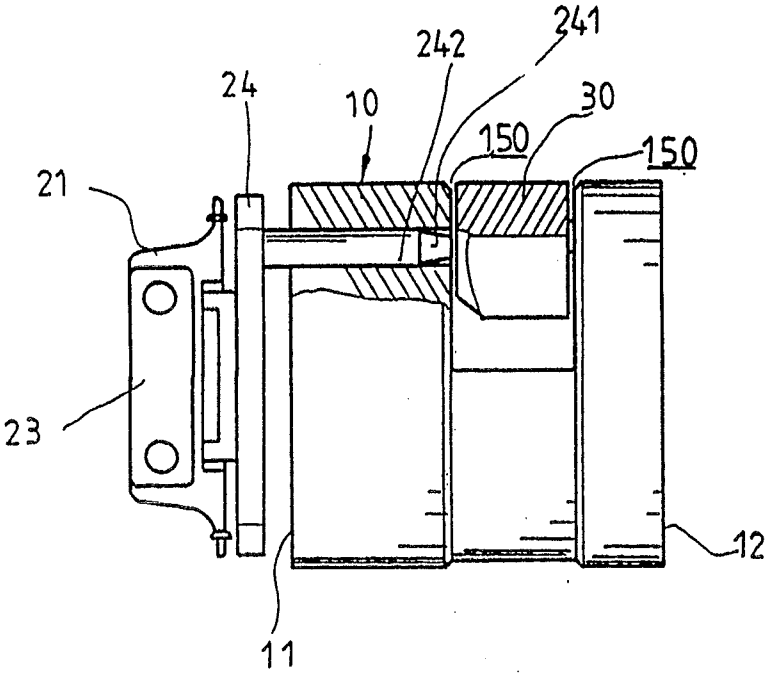

The closed end 12 of the main body 10 has two holes 17 formed thereon in such locations that when the disk 24 is movably fit over the projection 121, the control pins 241 are received within the holes 17 to be movable, by the movement of the disk 24 relative to the projection 121, between a first position (engaging position) where the free ends 242 of the control pins 241 extend out of the holes 17 and enter the notch 15 to be located closely under the wings 33 and 34 of the coupling member 30 so as to contactingly engage and thus prevent the coupling member 30 from rotation relative to the main body 10 and to maintain the coupling member 30 at the neutral position thereof, as shown in FIGS. 3 and 5, and a second position (withdrawal position) where the control pins 241 are withdrawn into the holes 17 and thus forming no constraint to the rotation of the coupling member 30 relative to the main body 10, as shown in FIGS. 4 and 6.

Preferably, the free end 242 of each of the control pins 241 is tapered to form a truncated conic shaped end portion and the coupling member 30 has an inclined edge surface 32 formed on one side thereof facing the closed end 12 of the main body 10 to cooperate with the tapered ends 242 of the control pins 241 for facilitating the movement of the control pins 241 to the first position under the wings 33 and 34 and helping forcing the wings 33 and 34 to move from the working position back to the neutral position by the camming engagement therebetween.

The centrifugal clutch 20 further comprises a base plate 25 which has a central Square opening 251 to be fit over and secured on a Square section 123 of the projection 121 of the main body 10. The base plate 25 secured on the projection 121 serves as a stop to prevent the disk 24 from moving off the projection 121.

The base plate 25 has two inclined side extensions 252 bent toward the disk 24 and having formed thereon a slit 253. The centrifugal clutch 20 further comprises a pair of rotatable arms 21, each having a circular cut-off 212 to fit on the cylinder 243 of the disk 24 and a lying-down U-shaped slit 213 to provide a tab 214 to insert into the slit 253 of each of the side extensions of the base plate 24 for forming a pivot joint therebetween which allows the arms 21 to be rotatable relative to the base plate 25 about the pivot joint.

A pair of helical springs 22 are secured between the two arms 21 to bias the arms 21 toward each other by rotating about the pivot joints between the arms 21 and the base plate Each of the arms 21 also has an end tips 215 in contact engagement with an inclined camming surface 244 formed on the cylinder 243 of the disk 24 so that when the arms 21 are rotated relative to the base plate 25, the disk 24 is moved relative to the projection 121 of the main body 10 by the camming engagement between the end tips 215 of the rotatable arms 21 and the inclined surfaces 244 of the disk 24.

Each of the arms 21 has an end flange 211 to which a weight 23 is secured to provide a movement to the arms 21 against the helical spring 22 with the centrifugal force acting thereupon when the centrifugal clutch 20 is rotated at a high speed.

In operation, the rotational speed of the main body 10 which is driven by the spindle 104 of the motor 102 generates a centrifugal force acting upon the weights 23 of the centrifugal clutch 20 to rotate the arms 21 relative to the base plate 25 against the biasing force of the helical springs 22. Under this situation, the disk 24 is moved relative to the cylindrical projection 121 of the main body 10 to withdraw the control pins 241 out of the notch 15 to the withdrawal position thereof and thus allowing the coupling member 30 to rotate relative to the main body 10 and having one of the wings 33 and 34 thereon move into the notch 15, the working position shown in FIGS. 4 and 6, to hit and impact one of the toothed portions 41 of the output shaft 40 so as to transmit a torque impulse or rotation to the driving tip 105 to loosen/tighten a nut or a bolt.

On the other hand, once the driving tip 105 is engaged with a nut or bolt, the rotation of the output shaft 40 is stopped by the reaction torque from the nut or bolt to be loosened/tightened. Under this situation, the biasing force of the helical springs 22 gets greater than the centrifugal force provided by the rotation of the weights 23 so as to force disk 24 and the control pins 241 to move toward the main body 10 and thus the control pins 241 enter again into the notch 15 (the engaging position) to force the coupling member 30 back to the neutral position thereof (FIGS. 3 and 5). The rotation of the output shaft 40 then resumes due to the disengagement of the coupling member 30 from the toothed portions 41 of the output shaft 40. The repeated high speed and low speed cycle of the output shaft 40 will continue until the nut or bolt is tightened or loosened.

Turning back to FIG. 1, to help an operator of the power wrench 100 to perform a bolt tightening/loosening operation in a dark environment, a light source or lightening means, preferably a small lamp bulb 108, is mounted on the front end of the housing 101, preferably next to the driving tip 105 of the output shaft 40 to project light beam to the nut or bolt to be tightened/-loosened so as to allow the operator to monitor the operation. The lighting means 108 may be switched on/off by a switch (not shown) mounted on the handle 106. Alternatively, the lighting means may be always turned on once the power wrench 100 is turned on.

Also referring to FIG. 2, to more securely hold a socket on the driving tip 105 for performing nut/bolt tightening/loosening operation, the driving tip 105 is provided with a circumferential groove 109 in which a resilient ring, such as a rubber ring 110 is fit. An open ring 111, which is preferably made of metal, such as steel, is fit over the rubber ring 110. The open ring 111 has an outside diameter slightly larger than the driving tip 105, but is compressible to be smaller than the driving tip 105 by compressing the rubber ring 110 so that when the socket is engaged by the driving tip 105, the rubber ring 110 provides a contact force via the steel ring 111 to the inside surface of the socket that contacts the driving tip 105 and thus helps more securely holding the socket on the driving tip 105.

It is apparent that although the invention has been described in connection with the preferred embodiment, it is contemplated that those skilled in the art may make changes to the preferred embodiment without departing from the scope of the invention as defined in the appended claims.

What is claimed is

1. A wrench comprising a housing inside which a torque source is disposed to drive a driving tip extending out of a front end of the housing via a torque/rotation transmission mechanism, said torque/rotation transmission mechanism comprising:

a hollow cylindrical main body having a closed end and an open end connected by a cylindrical circumferential side wall, the closed end having a projection co-axially mounted thereto to be drivingly coupled to the torque source, the main body further comprising a radial notch formed on the side wall thereof to rotatably receive and secure therein a coupling member of complemental shape and size by means of a pivot pin, the coupling member having two wings, each wing having a remote end extending laterally from a central portion of the coupling member through which the pivot pin extends so that the wings are rotatable relative to the main body about the pivot pin between a neutral position where the remote ends of the wings are maintained flush with the side wall of the main body and a working position where the remote end of one of the wings is moved further into the notch;

an output shaft having an expanded end on which two toothed portions are formed, each tooth portion comprising a flat surface extending substantially along a radial direction of the expanded end and facing in a circumferential direction of the expanded end toward each other, the expanded end of the output shaft being rotatably received within the hollow main body to be freely rotatable therein when the coupling member is in the neutral position and contactingly engageable by the remote end of the one of the wings with one of the flat surfaces thereof when the coupling member is in the working position, the output shaft further comprising an opposite end extending out of the front end of the housing with the driving tip formed thereon;

a centrifugal clutch comprising a disk axially movably fit over the projection of the main body with at least one control pin integrally mounted to a first surface of the disk to be movably received within a corresponding through hole formed on the closed end of the main body so as to be moveable relative to the closed end between an engaging position where a free end of the control pin extends out of the through hole and enters the notch thus contactingly engaging the coupling member to prevent the coupling member from rotation and a withdrawal position where the free end of the control pin is withdrawn into the through hole and thus disengaged from the coupling member, the centrifugal clutch further comprising a base member secured to the projection of the closed end of the main body to be rotatable in unison therewith, a pair of weights being pivotally mounted to the base member and spring-biased toward a concentrated position where the weights are close to each other, rotation of the main body generating centrifugal force on the weights which overcomes the biasing force of the spring and moves the weights to a separated position where the weights are away from each other, mechanical coupling means being provided between the weights and the disk so that when the weights move from the concentrated position to the separated position, the control pin is driven from the engaging position to the withdrawal position so as to allow the coupling member to rotate relative to the main body and thus the wings are allowed to move from the neutral position to the working position to be engageable by the toothed portions of the output shaft and when the weights are moved from the separated position back to the concentrated position, the control pin is driven from the withdrawal position to the engaging position to fix the coupling member in the neutral position; and lighting means mounted in the front end of the housing.

2. The wrench as claimed in claim 1, wherein the free end of the control pin comprises a tapered end portion.

3. The wrench as claimed in claim 2, wherein the coupling member comprises an inclined edge facing the closed end of the main body to be camming engageable with the tapered end of the control pin for facilitating the movement of the free end of the control pin to the engaging position.

4. The wrench as claimed in claim 1, wherein the disk has two control pins integrally mounted thereon.

5. The wrench as claimed in claim 1, wherein the lighting means comprises a lamp.

6. The wrench as claimed in claim 1, wherein the driving tip comprises a circumferential groove formed thereon into which a resilient ring is received, an open ring which has an outside diameter slightly larger than the driving tip being fit over the resilient ring.

7. The wrench as claimed in claim 6, wherein the resilient ring is made of rubber and the open ring is made of steel.

* * * * *